US007354360B1

(12) United States Patent
Eckstein

(10) Patent No.: US 7,354,360 B1
(45) Date of Patent: Apr. 8, 2008

(54) METHOD AND APPARATUS FOR TEACHING A USER HOW TO HIT A BALL WITH A BAT

(75) Inventor: Rick Eckstein, Sanford, FL (US)

(73) Assignee: Ecksports, LLC, Sanford, FL (US)

( * ) Notice: Subject to any disclaimer, the term of this patent is extended or adjusted under 35 U.S.C. 154(b) by 114 days.

(21) Appl. No.: 10/922,111

(22) Filed: Aug. 19, 2004

Related U.S. Application Data

(60) Provisional application No. 60/547,017, filed on Feb. 20, 2004, provisional application No. 60/497,143, filed on Aug. 21, 2003.

(51) Int. Cl.
*A63B 71/00* (2006.01)

(52) U.S. Cl. ..... 473/417; 473/422

(58) Field of Classification Search ..... 473/417, 473/453, 418–420, 422, 543; D21/715, 780; 248/158

See application file for complete search history.

(56) References Cited

U.S. PATENT DOCUMENTS 1,463,734 A * 7/1923 Ullrich ..... 248/524
1,932,143 A * 10/1933 Piercy ..... 362/398
2,616,692 A 11/1952 Bird
2,652,250 A 9/1953 Alder et al.
2,884,250 A 4/1959 Patterson
2,947,563 A * 8/1960 Stitt ..... 294/65.5
2,976,041 A 3/1961 White
2,977,082 A * 3/1961 Harris ..... 248/206.5
2,978,215 A * 4/1961 Shanok et al. ..... 248/115
3,139,282 A * 6/1964 Lande ..... 473/417
3,245,165 A * 4/1966 Podoloff ..... 40/591
3,331,043 A * 7/1967 Orzabal ..... 335/285
3,489,411 A * 1/1970 Morelli et al. ..... 473/417
3,862,756 A * 1/1975 Selliken ..... 473/501
4,105,204 A * 8/1978 Koenig ..... 473/461
4,227,691 A 10/1980 Lefebvre et al.
4,383,686 A 5/1983 Cardieri
4,419,644 A * 12/1983 Baermann ..... 335/288
4,445,685 A 5/1984 Cardieri
4,456,250 A 6/1984 Perrone, Jr.
4,575,080 A 3/1986 Miles
4,619,456 A 10/1986 Meggs
4,664,374 A 5/1987 Groves
4,690,403 A 9/1987 Meggs
4,709,924 A 12/1987 Wilson et al.
4,796,885 A 1/1989 Wright
4,819,937 A 4/1989 Gordon
4,886,267 A 12/1989 Licciardi et al.
4,962,924 A * 10/1990 James ..... 473/417
4,976,431 A 12/1990 Guenther
4,989,866 A 2/1991 Dill
5,004,234 A 4/1991 Hollis
5,039,100 A * 8/1991 Cortese ..... 273/127 B
5,076,580 A 12/1991 Lang
5,100,134 A * 3/1992 Becker ..... 473/417
5,306,000 A * 4/1994 Comella ..... 473/133

(Continued)

*Primary Examiner*—Eugene Kim
*Assistant Examiner*—M. Chambers
(74) *Attorney, Agent, or Firm*—Holland & Knight LLP

(57) ABSTRACT

Disclosed is an apparatus for teaching a user how to hit a ball with a bat. The apparatus includes a telescopically adjustable tee assembly that is magnetically secured to an underlying base. A user can easily make adjustments to both the vertical height of the tee and its location upon the base in order to simulate different pitch types.

4 Claims, 4 Drawing Sheets

U.S. PATENT DOCUMENTS

| | | | | |
|---|---|---|---|---|
| 5,388,823 | A | 2/1995 | Prieto | |
| D373,806 | S | 9/1996 | Bunnell | |
| 5,556,091 | A | 9/1996 | Lin | |
| 5,580,047 | A | 12/1996 | Shih et al. | |
| 5,662,536 | A | 9/1997 | Martinez | |
| 5,690,565 | A | 11/1997 | Swanson | |
| 5,848,945 | A | 12/1998 | Miller et al. | |
| 5,916,045 | A | 6/1999 | Busch | |
| 6,099,418 | A | 8/2000 | Owen | |
| 6,238,307 | B1 * | 5/2001 | Owen | 473/417 |
| 6,358,163 | B1 | 3/2002 | Tanner | |
| 6,682,445 | B1 | 1/2004 | Tanner | |
| 2003/0032506 | A1 | 2/2003 | Chi | |
| 2003/0036446 | A1 | 2/2003 | Udwin et al. | |

* cited by examiner

FIG 3
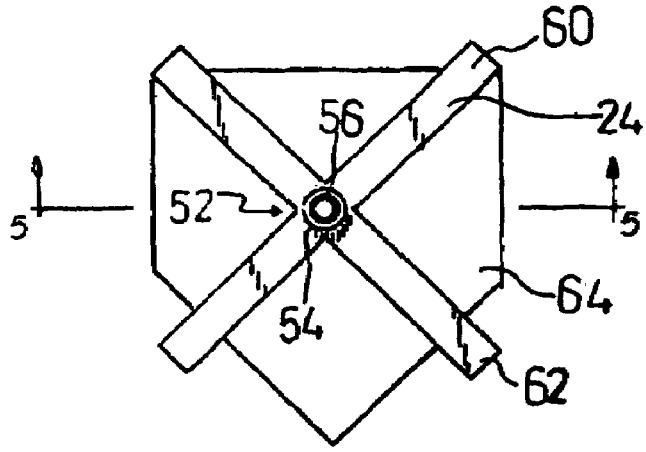
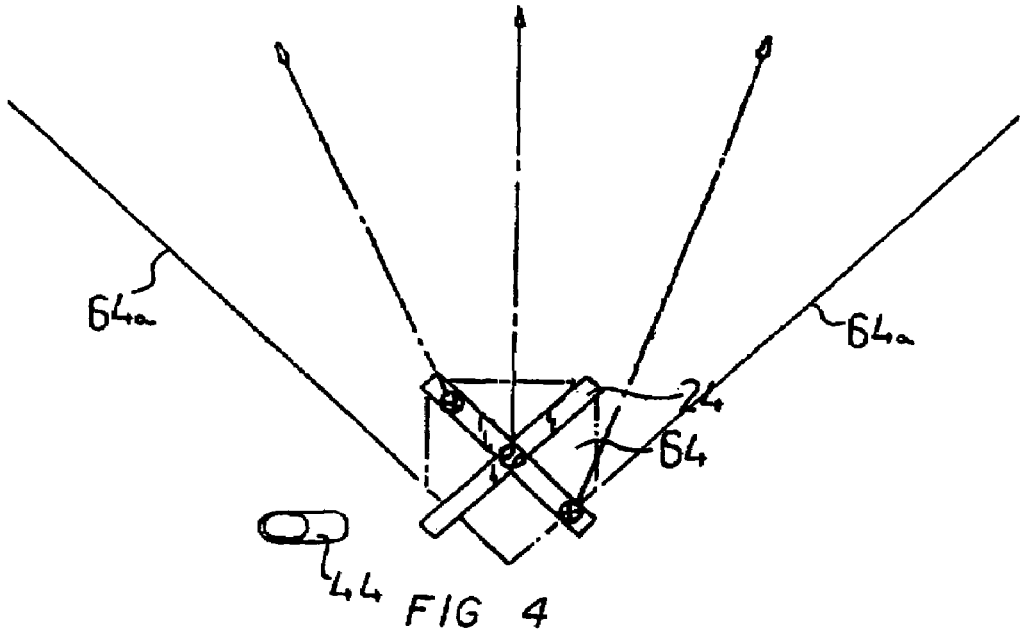
FIG 4

FIG 6
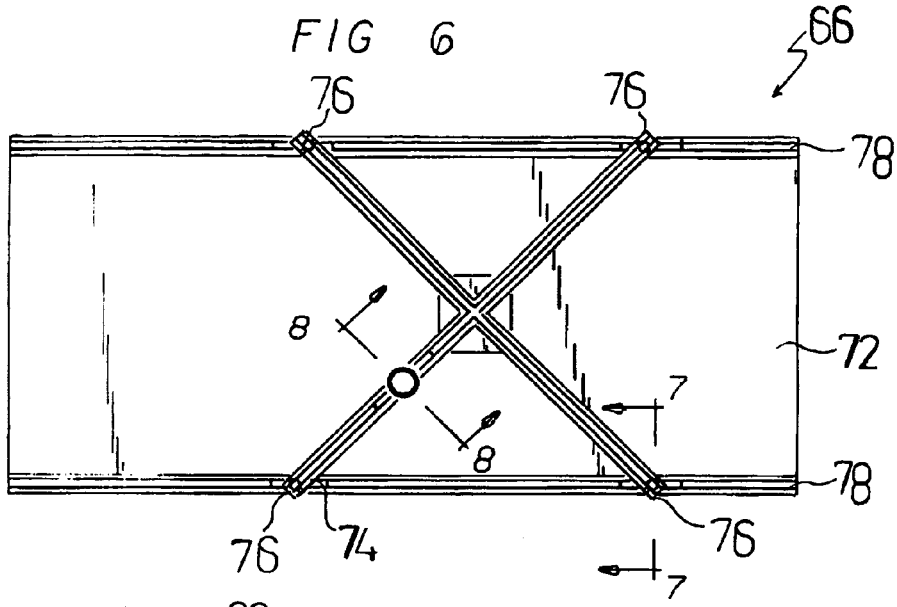
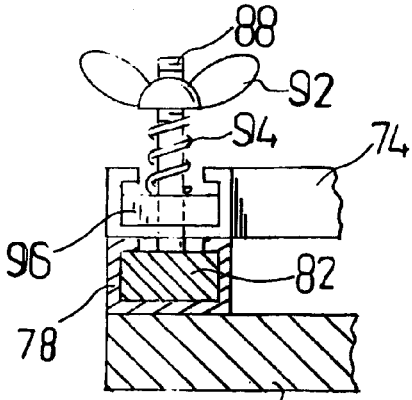
FIG 7
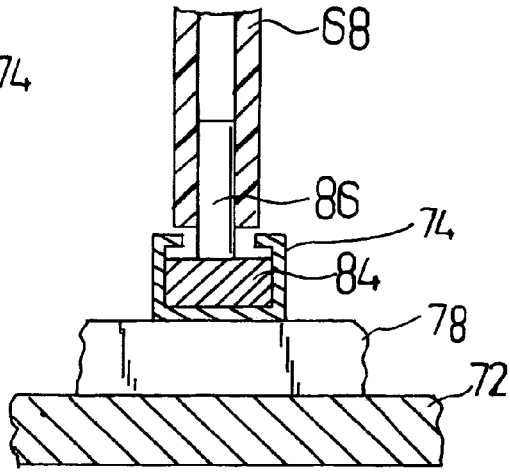
FIG 8

METHOD AND APPARATUS FOR TEACHING A USER HOW TO HIT A BALL WITH A BAT

RELATED APPLICATION DATA

This application claims priority from provisional application Ser. No. 60/497,143 filed on Aug. 21, 2003 entitled "Adjustable Batting Tee" and provisional application Ser. No. 60/547,017 filed on Feb. 20, 2004 entitled "Magnetic Adjustable Batting Tee." The contents of both provisional applications are incorporated herein by reference.

BACKGROUND OF THE INVENTION

1. Field of the Invention

This invention relates to a tee for use in batting practice. More particularly, the present invention relates to a vertically adjustable tee that can be secured at any number of locations upon an underlying base.

2. Description of the Background Art

The use of batting tees is known in the art. Batting tees conventionally include a mat, often in the shape of a baseball home plate, upon which a cylindrical tee is mounted. The tee functions in supporting a ball at an appropriate height to allow users to practice hitting. Adjusting the horizontal distance between the tee and batter can only be accomplished by either moving the entire tee or changing the stance of the user. Thus, conventional batting tees are not at all adjustable, with changes to ball position requiring either replacement of the entire tee or movement by the user. This leaves the user guessing at how and where to simulate different pitches (e.g. outside as compared to inside). The lack of adjustability is a major drawback, as the proper position between tee and batter is critical for proper hitting instruction.

Over the years inventors have attempted to overcome the adjustability problems inherent in conventional tee designs. For example, U.S. Pat. No. 3,139,282 to Lande discloses a batting apparatus with a telescopically adjustable tee. Further adjustability is provided by mounting the tee upon an elongated support bracket that is secured to a base by way of a bolt and a wing nut.

Another tee construction is disclosed in U.S. Pat. No. 4,962,924 to James. The device of James includes a vertically adjustable tee that is positioned within one of a plurality of slots formed within the upper surface of a base plate. The tee is adjustably secured within the slot via a threaded fastener.

Yet another adjustable tee construction is provided by U.S. Pat. No. 5,388,823 to Prieto. This tee includes a first elongated member that is attached to a baseball plate, and a second elongated member is slideably and rotatably secured to the first member. A telescopic tee is attached to one end of the second member. This tee construction allows the ball to be positioned at a variety of locations relative to the base.

Finally, U.S. Pat. No. 6,099,418 to Owen discloses a telescopically adjustable tee member that is slideably positioned within one of a pair of crossed tracks via a threaded track follower. The tracks are positioned upon a planar base member with a raised portion in the form of a baseball home plate. Once the tee is positioned at a desired location upon the base, its lower end is rotated to lock it within the track. Because the lower end is locked, this tee is more susceptible to breaking upon impact with a bat.

Although each of the above referenced devices achieves its individual objective, they all suffer from a common drawback: complexity of adjustment. Practice tees must be readily adjustable to accommodate a user's particular size and hitting style, facilitate hitting balls to various locations in the field of play, and simulate different pitch types and trajectories. Thus, there exists a need in the art for a tee that can be easily and quickly adjusted by a single user without the need for tools. The adjustable batting tee of the present invention substantially fulfills this need.

SUMMARY OF THE INVENTION

It is therefore one of the objectives of this invention to provide an easily adjustable practice tee, with the adjustability promoting use by individuals of various size and with differing hitting postures.

It is also an object of the present invention to provide a tee with an uncomplicated and easy to use adjustment mechanism, thereby facilitating use of the tee in simulating different pitch types and trajectories.

It is likewise an object of this invention to enable a practice tee to be positioned at an infinite number of locations on the maximal line of contact for a batter relative to his stance and strike zone.

Still another object of this invention is to permit a tee to be quickly maneuvered forward, rearward, or to the side of the strike zone, as compared to the batter's location in the batter's box.

These and other objectives are accomplished by providing a practice device for teaching users how to hit a ball with a bat. The device comprises a base relative to which a user stands to address the ball. The device further includes a tee with a ball support positioned over the upper end of the tee. A magnetic element is secured to the lower end of the tee and allows the tee to be magnetically coupled to the base.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which:

FIG. 3 is a top plan view taken along line 3-3 of FIG. 2.

FIG. 4 is an illustration of the different hitting trajectories that can be achieved by adjusting the practice tee of the present invention.

FIG. 6 is a top plan view of an alternative tee construction of the present invention.

FIG. 7 is a detailed view of the locking mechanism of the alternative embodiment taken along line 7-7 of FIG. 6.

FIG. 8 is a detailed view of the tee mount of the alternative embodiment taken along line 8-8 of FIG. 6.

Similar reference characters refer to similar parts throughout the several views of the drawings.

DETAILED DESCRIPTION OF THE PREFERRED EMBODIMENT

The present invention relates to an apparatus and method for allowing users to practice hitting a ball with a bat. The apparatus takes the form of an adjustable tee that allows use by individuals of various sizes and with different hitting styles. The adjustability further allows users to simulate hitting different pitch trajectories into different areas in the field of play. To achieve the foregoing, the tee apparatus includes simple mechanisms that allow users to easily make adjustments in both the vertical and horizontal direction. The various components of the tee apparatus of the present invention, and the manner in which they interrelate, are described in greater detail hereinafter.

Figure 1:
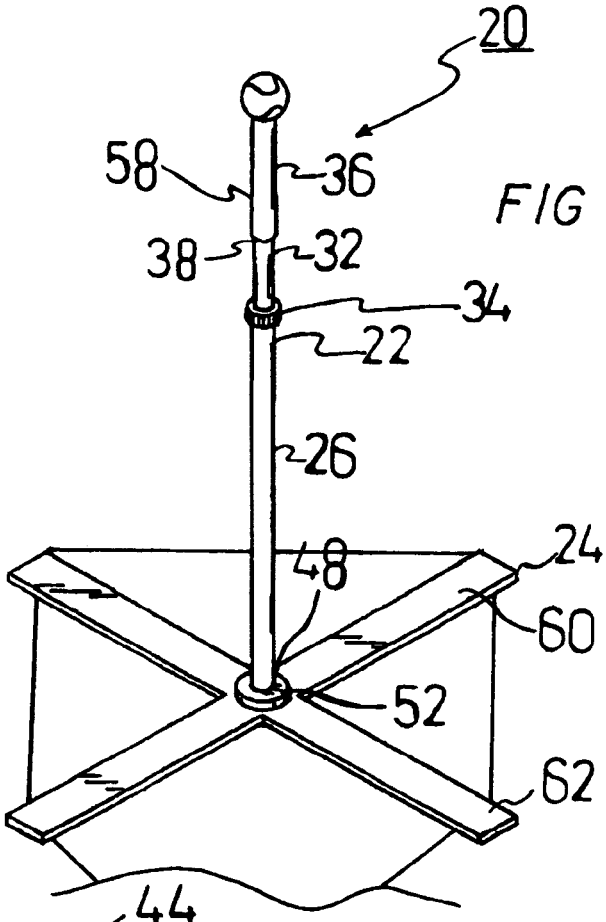
FIG. 1 is a perspective view of the practice tee of the present invention.

FIG. 1 is a perspective view of the preferred tee apparatus 20 of the present invention. The apparatus 20 has two basic components: a tee assembly 22 and a base 24. Tee assembly 22 is preferably constructed from two telescopically interrelated components. Namely, tee assembly 22 includes a female extent 26, with a hollow interior 28 (note FIG. 5), into which a male extent 32 is slideably positioned. These extents (26 and 32) are preferably formed from a hardened lightweight plastic material. Nonetheless, it is within the scope of the present invention to form the male and female extents (26 and 32) from other materials, such as aluminum or stainless steel.

Figure 5:
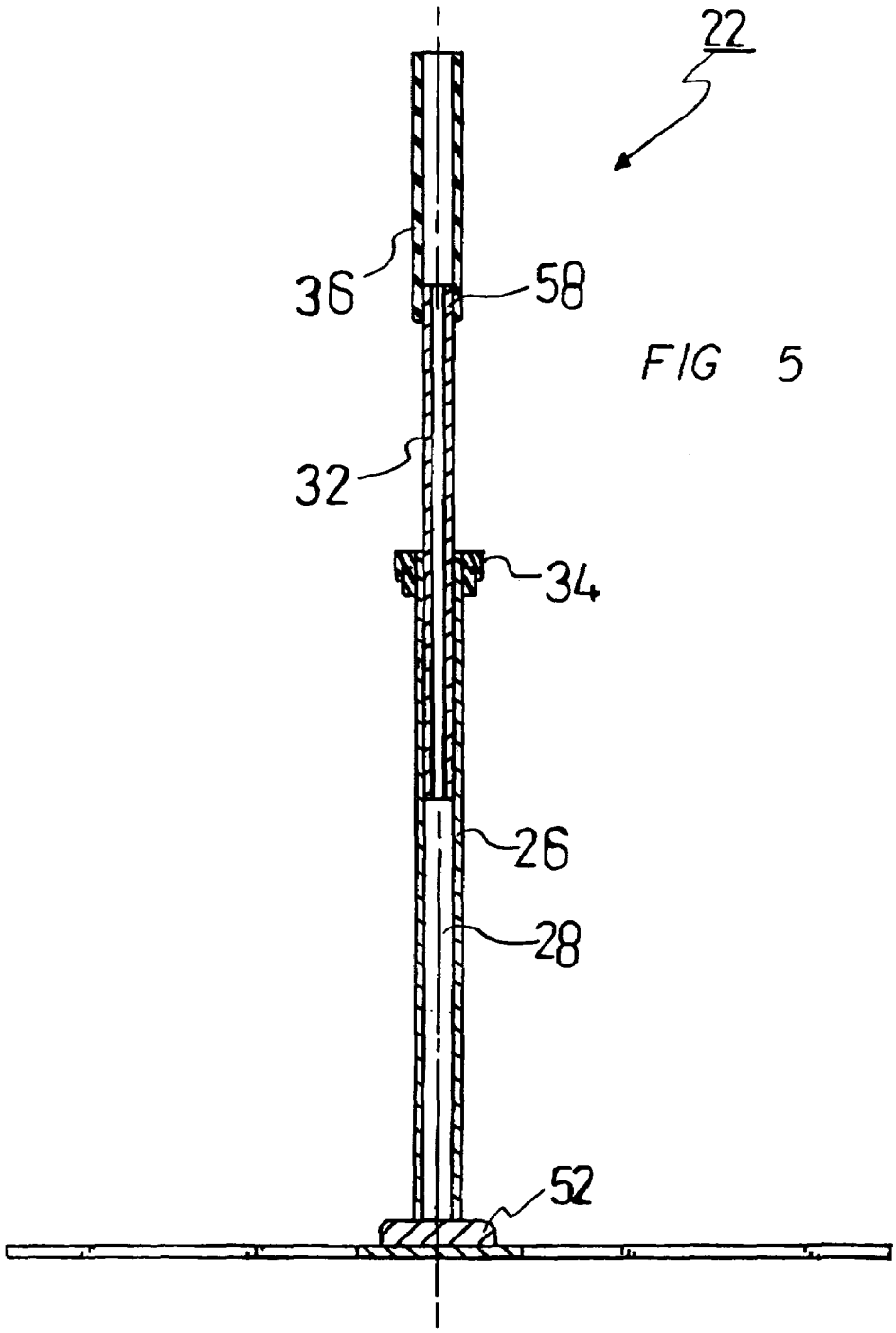
FIG. 5 is a sectional view taken along line 5-5 of FIG. 3.

With reference now to FIG. 5, the relationship between the male and female extents (26 and 32) is depicted. Specifically, female extent 26 preferably has an inside diameter sufficient to accept the outside diameter of the male extent 32. Furthermore, in the preferred embodiment, male extent 32 is hollow to reduce the overall weight of the assembly. Adjustability between the two extents (26 and 32) is provided by securing a rubber friction fitting 34 to an upper end of female extent 26. Fitting 34 operates to frictionally engage male extent 32 such that it maintains a desired position relative to female extent 26. Manual force exerted by a user (either upward or downward) is sufficient to overcome the frictional engagement and allow male extent 32 to be positioned at a different vertical position. This vertical adjustability allows users to simulate pitches thrown at different trajectories and also allows tee apparatus 20 to be used by different sized individuals. Other means of connecting the two extents (26 and 32) can also be used, such as a threaded fitting, which would tighten down upon rotation, or cam-type latch, which would retain male extent 32 depending upon the lever orientation.

With continuing reference to the Figures, and FIGS. 1 and 5 in particular, the ball support 36 of the present invention is depicted. In the preferred embodiment, ball support 36 is formed from a soft, resilient, thermoplastic material. Support 36 is also cylindrical and hollow (note FIG. 5) to allow it to be inserted over, and frictionally retained upon, the upper end 38 of male extent 32. To provide for a proper fitting, ball support 36 has an inside diameter that is only slightly larger than the outside diameter of male extent 32. Ball support 36 is also positioned over male extent 32 with a sufficient degree of overlap such that it is positively secured and cannot be unintentionally removed. Furthermore, ball support 36 preferably has an outside diameter that is sufficient to support the type of ball being hit. Namely, the size of ball support 36 will depend upon the type of ball it is designed to support (e.g. baseball, softball, tennis ball, wiffle ball, cricket ball, etc.). The present invention is in no way limited to the type of ball being employed or the sport with which it is used.

Figure 2:
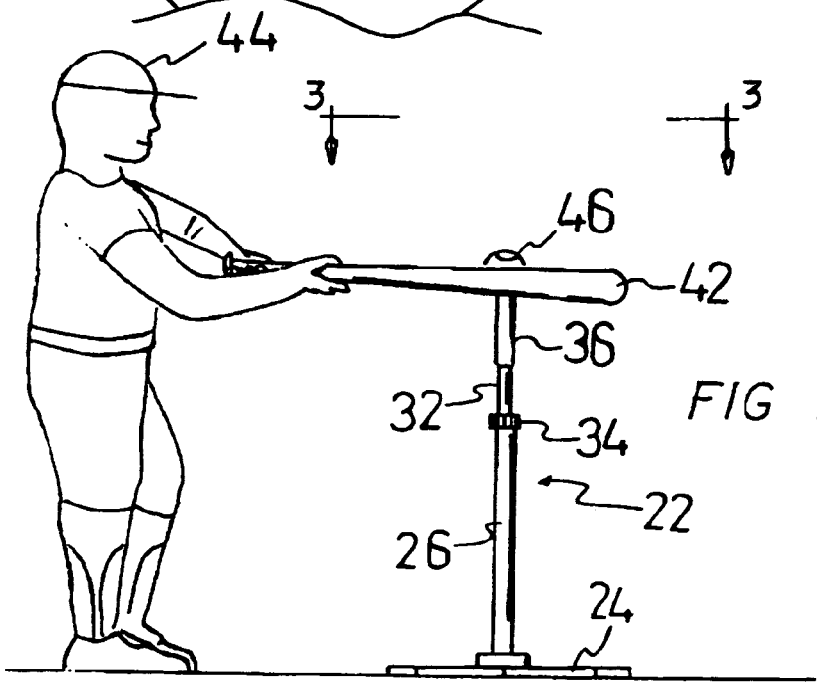
FIG. 2 is a rear elevational view of a batter addressing a ball supported by the tee of the present invention.

The resiliency of ball support 36 allows it to absorb impacts from a bat 42 on those occasions when a user 44 does not make a clean impact with the ball 46. FIG. 2 illustrates a typical example of a user 44 making simultaneous contact with both ball 46 and ball support 36. Ball support 36 is also sized such that it can bend relative to the remainder of tee assembly 22, further adding to its resilience. Without the resilient support, the entire tee apparatus 20 would be susceptible to tipping over upon impact with bat 42, and either tee assembly 22 or male extent 32 would be susceptible to damage.

Although the preferred material for ball support 36 has been described as thermoplastic, the use of other materials is within the scope of the present invention. The only requirement of the material is that it be resilient and, at the very least, more resilient than the material used to form the male extent 32 of tee assembly 22. For example, in an alternative construction, ball support 36 is formed from a dense grouping of upstanding bristles. The bristles are rigid enough to support a ball 46, but have enough give to prevent an impact from being transferred to the remainder of tee apparatus 20.

The bottom 48 of tee assembly 22 terminates in a circular magnet disc assembly 52 that is used in securing the entire tee assembly 22 to the underlying base 24 as noted in FIG. 1. More specifically, a cylindrical housing 54 (note FIG. 2) is threadably secured to lowermost end 48 of female extent 26. A circular magnet 56, shaped to conform to the interior of the housing 54, is then fastened into housing 54 via fastening means, such as threaded fasteners. Circular magnet 56 is preferably very strong so as to securely attach the entire tee assembly 22 to the upper surface of metallic base 24. In the preferred embodiment, magnet 56 is a neodymium iron boron (NdFeB) magnet and provides sufficient magnetic coupling to prevent the unintended movement of tee assembly 22 by the user 44 and also prevents tee assembly 22 from separating from the base in the unlikely event contact occurs between the bat 42 and the tee assembly 22.

Removal of tee assembly 22 from base 24 can only be achieved by a user stepping on a corner of base 24 and pivoting tee assembly 22 (preferably by grasping the uppermost end 58 of tee assembly 22), to break the magnetic bond. Once the bond is broken, tee assembly 22 can be repositioned at any of an infinite number of locations upon base 24. Once the desired location is reached, the user places magnet disc assembly 52 upon base 24 in a manner that brings the entire surface area of magnet 56 into contact with base 24, thereby ensuring the greatest degree of magnetic attraction and coupling power.

Base 24 of the present invention is disclosed in FIGS. 1 and 3. The base 24 of the preferred embodiment has two legs (60-62) that are integrally formed and positioned at a 90° angle with respect to each other. With base 24 centered over a home plate 64, as noted in FIG. 3, the two legs (60-62) form maximal lines of contact for either a left or right handed batter relative to his stance and strike zone. This figure also demonstrates that each leg (either 60 or 62) of base 24 is slightly larger than the length or width of a regulation size baseball homeplate. Of course, the dimensions and configuration of base 24 may be altered depending upon the type of sport tee apparatus 20 is designed to be used with. Ideally, base 24 is formed from a metallic material, such as steel, to allow it to form a magnetic coupling with magnetic disc assembly 52 and tee assembly 22 (as noted by disc assembly 52). Base 24 is also powder coated and painted to provide a smooth and aesthetically pleasing appearance. Although a metal base is disclosed as preferred, base 24 could be formed from a magnetic material with a polarity opposite that of magnet 56. Alternatively, magnet 56 could be replaced with a metallic disc and base 24 could be entirely formed from a magnetic material. The only requirement is that the disc assembly 52 and base 24 be coupled magnetically.

Other constructions for base 24 are within the scope of the present invention. For example, the two legs (60-62) of base 24 can be pivotally interconnected to allow the angle between them to be adjusted and to allow the legs to overlap for convenient storage and/or transport. Still yet another alternative is to provide folding legs to again facilitate storage and transport. Base 24 can also be formed with more or less legs than shown in the preferred embodiment. The configuration for base 24 will largely depend upon the type of sport the user is practicing for (e.g. baseball, softball, wiffle ball, cricket, etc.)

In addition to tee assembly 22 being adjustable relative to base 24, the base 24 can be adjusted relative to an underlying plate 64. Specifically, the magnetic coupling between tee assembly 22 (as noted by disc assembly 52) and base 24 is strong enough such that both can be picked up by lifting upwards on the tee. Lifting up on tee assembly 22, as opposed to pivoting it relative to the base, allows the entire apparatus 20 to be maneuvered to any location with respect to underlying plate 64, such as a baseball home plate. For example, in the plan view of FIG. 3, base 24 and tee assembly 22 are centrally located with respect to plate 64. However, base 24 and tee assembly 22 can be moved forward, rearward of to either side of this position or anywhere else in or out of the batter's box (such as to the front or back), depending upon the type of pitch being simulated. Again, this adjustment is easily accomplished by the user merely picking up the apparatus 20 via the tee assembly 22 and moving it to the desired location.

Thus, in operation, a user places base 24 upon the ground over an actual baseball plate 64, adjacent a practice location. Thereafter, tee assembly 22 is magnetically secured to a point along the length of either the first or second legs (60-62) of base via the magnetic disc assembly 52. By making appropriate adjustments to the position of base 24, the location of tee assembly 22 upon base 24, and the vertical height of male tee extent 32, any type of pitch can be easily simulated. FIG. 4 illustrates just a few of the pitches that can be simulated for a right handed batter and their corresponding trajectories into the field of play. Similar trajectories can be achieved by left handed batters from the opposite leg of the base. Lines 64*a* denote the foul line. The apparatus 20 of the present invention can be used to simulate pitches thrown down the middle, down-and-away, high-and-away, high-and-inside, high-and-outside, or any other pitch type thrown either in or out of the strike zone. Moreover, a single user can easily and quickly make the adjustments necessary to simulate different pitch types via the friction fitting 34 and magnetic disc assembly 52.

Alternative Embodiments

An alternative embodiment 66 of the present invention is illustrated in FIGS. 6-8. Here, a tee assembly 68 is mounted upon a board 72 and a pair of crossed rails 74. The lower end of the tee 68 is slideably positioned within one of the crossed rails 74 to permit adjustment. Additionally, the outer edges 76 of crossed rails 74 are fitted into grooves 78 upon board 72 such that cross rails 74 can be slid lengthwise along the board 72.

With reference to FIG. 6, the assembly 66 includes board 72 which forms the base of the practice tee. Board 72 can be constructed from a variety of suitable materials, such as wood, a hardened plastic or a light weight metal. Board 72 can also come in a variety of shapes, although the depicted shape is rectangular. A pair of channels 78 are secured to the board in the lengthwise direction. As depicted in FIGS. 6 and 7, these lengthwise channels 78 accept a series of sliding blocks 82 that are positioned at the outer edges 76 of crossed rails 74.

Specifically, four blocks 82 are positioned within the two lengthwise channels 78 of board 72 (two blocks per side) and permit crossed rails 74 to be maneuvered lengthwise along board 72. The lengthwise rails 78 can be constructed from any suitable material, such as a rigid plastic or metal. As noted in FIGS. 7 and 8, crossed rails 74 are positioned on top of the lengthwise rails 78. Each of the crossed rails 74, in turn, includes a tee mount 84 and upstanding post 86 that are slidably positioned within the rail. The upstanding post 86 is dimensioned to fit within the bottom of the telescopically adjustable tee 68 to thereby secure the tee 68 to the tee mount 84, (note FIG. 8). This arrangement permits tee 68 to be slid and positioned anywhere along the length of the first or second rail. Movement between adjacent rails is accomplished by transferring tee 68 between posts 86 of adjacent tee mounts 84. As can be appreciated from FIG. 1, the tee 68, and associated tee mounts 84 and posts 86, can be positioned anywhere upon the X configuration defined by the crossed rails 74. As noted in conjunction with the previous embodiment, the tee 68 is telescopically adjustable.

As illustrated in FIG. 6, each of the crossed rails 74 has a block 82 at its distal end that is slidably positioned within one of the lengthwise channels 78 of board 72. Crossed rails 74 are secured to lengthwise channels 78 via a series of threaded fasteners 88. Namely, a threaded fastener 88 is positioned through the end 76 of each of the crossed rails 74 and is secured to the corresponding sliding block 82. A wing nut 92, spring 94 and washer 96 are then used to selectively secure the end 76 of the crossed rail to the underlying lengthwise channel 78. Movement of the crossed rails 74 with respect to the underlying channels 78 can only be accomplished by first loosening each wing nut 92 to thereby release the tension within the corresponding spring 94. By completely removing each of the wing nuts 92, the crossed rails 74 can be separated from the lengthwise channels 78 for transportation and/or storage. Consequently, the crossed rails 74 can be positioned at any location along the length of board 72. Ideally, board 72 is long enough to permit the tee 68 to be positioned forward, rearward, or over top of an underlying base. In one embodiment, a base is positioned above board 72 but beneath cross rails 74. The base can either be an actual base, or it can be a painted indication of the position of a base.

Thus, in operation, a user places board 72 upon the ground adjacent a practice location. Thereafter, tee 68 can be adjusted telescopically to the proper vertical height. Next, blocks 82 can be maneuvered along the length of board 72 such that cross rails 74 and tee 68 are positioned at a desired location along board 72. Thereafter, tee 68 is selectively positioned at a point along the length of either the first or second rails 74 via tee mounts 84. In this manner, the user can position tee 68 in a manner that best simulates the desired pitch.

Still yet other embodiments are within the scope of the present invention. For example, a magnetic coupling similar to that depicted in FIG. 1 could replace the sliding blocks 82 and tee mounts 84 depicted in FIGS. 6-8. Thus, in this embodiment crossed rails 74 are magnetically secured to underlying lengthwise channels 78 and the tee is magnetically coupled to a location along the crossed rails 74. Such an embodiment would provide the required adjustability without the need for threaded fasteners.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

Now that the invention has been described,

What is claimed is:

1. A practice system for teaching users how to hit a baseball with a bat, the system comprising:

a plate, representative of a home plate in baseball, relative to which the user stands to address the ball with the bat;

a metallic base having first and second legs that are rotatably interconnected to one another, the base being positioned over the plate at any of a number of locations;

an adjustable tee including a female extent with an opened upper end and a lower end, a male extent with upper and lower ends, a friction fitting positioned upon the upper opened end of the female extent, the fitting adjustably securing the male extent within the female extent in a telescopic fashion;

a resilient ball support frictionally positioned over the upper end of the male extent;

a magnetic disc secured to the lower end of the female extent of the tee, the magnetic disc magnetically coupling the tee to any of an infinite number of locations upon either the first or second leg of the base, the magnetic coupling comprised of neodymium iron boron (NdFeB), being sufficient to prevent the tee from tipping over when the tee is struck by the bat.

2. The apparatus as described in claim 1 wherein the magnetic coupling is sufficient to prevent the tee from tipping over upon impact.

3. The apparatus as described in claim 1 wherein the tee is vertically adjustable.

4. The apparatus as described in claim 1 further including a ball support secured to the upper end of the tee.

* * * * *